US010624407B2

(12) United States Patent
Infusino et al.

(10) Patent No.: US 10,624,407 B2
(45) **Date of Patent: *Apr. 21, 2020**

(54) PAD ASSEMBLIES FOR A PROTECTIVE SPORTS HELMET

(71) Applicant: Riddell, Inc., Des Plaines, IL (US)

(72) Inventors: Ralph J. Infusino, Bloomingdale, IL (US); Vittorio Bologna, Elk Grove, IL (US); Thad M. Ide, Chicago, IL (US)

(73) Assignee: Riddell, Inc., Des Plaines, IL (US)

( * ) Notice: Subject to any disclaimer, the term of this patent is extended or adjusted under 35 U.S.C. 154(b) by 102 days.

This patent is subject to a terminal disclaimer.

(21) Appl. No.: 15/714,422

(22) Filed: Sep. 25, 2017

(65) Prior Publication Data

US 2018/0007992 A1 Jan. 11, 2018

Related U.S. Application Data

(63) Continuation of application No. 14/179,333, filed on Feb. 12, 2014, now Pat. No. 9,770,060.

(60) Provisional application No. 61/763,760, filed on Feb. 12, 2013, provisional application No. 61/763,762, filed on Feb. 12, 2013.

(51) Int. Cl.

| | |
|---|---|
| ***A42B 3/12*** | (2006.01) |
| ***A63B 71/10*** | (2006.01) |
| ***A63B 71/08*** | (2006.01) |

(52) U.S. Cl.

CPC ..... *A42B 3/122* (2013.01); *A42B 3/127* (2013.01); *A63B 71/081* (2013.01); *A63B 71/10* (2013.01)

(58) Field of Classification Search

CPC ..... A42B 3/12; A42B 3/121; A42B 3/122; A42B 3/125; A42B 3/127; A42B 3/147; A42B 1/08; A63B 71/081; A63B 71/10

USPC ..... 2/413, 414

See application file for complete search history.

(56) References Cited

U.S. PATENT DOCUMENTS

| | | | |
|---|---|---|---|
| 3,153,973 | A | 10/1964 | Marietta |
| 3,197,784 | A | 8/1965 | Sheldon |
| 3,274,613 | A | 9/1966 | Sowle |
| 3,568,210 | A | 3/1971 | Marietta |
| 3,609,764 | A | 10/1971 | Morgan |
| 3,713,640 | A | 1/1973 | Margan |
| 3,720,955 | A | 3/1973 | Rawlings |
| 3,761,959 | A | 10/1973 | Dunning |
| 3,785,395 | A | 1/1974 | Andreasson |
| 3,872,511 | A | 3/1975 | Nichols |
| 4,282,610 | A | 8/1981 | Steigerwald |
| 4,287,613 | A | 9/1981 | Schulz |
| 4,363,140 | A | 12/1982 | Correale |
| 4,370,759 | A | 2/1983 | Zide |
| 4,478,587 | A | 10/1984 | Mackal |
| 4,724,549 | A | 2/1988 | Herder |

(Continued)

*Primary Examiner* — Alissa L Hoey

(74) *Attorney, Agent, or Firm* — Barnes & Thornburg LLP

(57) ABSTRACT

A pad assembly is provided for use with a protective sports helmet in a contact sport, the helmet having an opening. The pad assembly includes a pad member within a pad housing, and a retainer having a projection that fits within the helmet opening. The pad assembly also includes a cap detachably coupled to the retainer, the cap including a base portion that fits within the helmet opening and a flange portion that fits within a countersunk recess disposed around the helmet opening, the cap detachably receiving the projection of the retainer. A protective sports helmet having a pad assembly is also provided.

22 Claims, 10 Drawing Sheets

(56) References Cited

U.S. PATENT DOCUMENTS

| | | | | |
|---|---|---|---|---|
| 4,853,980 | A | 8/1989 | Zarotti | |
| 5,014,365 | A | 5/1991 | Schulz | |
| 5,031,246 | A | 7/1991 | Kronenberger | |
| 5,175,889 | A | 1/1993 | Infusino | |
| 5,774,901 | A * | 7/1998 | Minami | A42B 3/147 2/421 |
| 5,941,272 | A | 8/1999 | Feldman | |
| 6,073,271 | A | 6/2000 | Alexander | |
| 6,079,053 | A | 6/2000 | Clover, Jr. | |
| 6,089,251 | A | 7/2000 | Pestel | |
| 6,154,889 | A | 12/2000 | Moore et al. | |
| 6,226,801 | B1 * | 5/2001 | Alexander | A42B 3/122 2/413 |
| 6,261,042 | B1 * | 7/2001 | Pratt | F16B 5/10 411/551 |
| 6,421,841 | B2 | 7/2002 | Ikeda | |
| 6,785,985 | B2 | 9/2004 | Marvin | |
| 6,934,971 | B2 | 8/2005 | Ide | |
| 7,900,279 | B2 | 3/2011 | Kraemer | |
| 8,328,159 | B2 | 12/2012 | Lee | |
| 8,544,117 | B2 | 10/2013 | Erb | |
| 8,813,269 | B2 * | 8/2014 | Bologna | A42B 3/20 2/425 |
| 9,770,060 | B2 * | 9/2017 | Infusino | A42B 3/122 |
| 2001/0034895 | A1 | 11/2001 | Ikeda | |
| 2008/0250550 | A1 | 10/2008 | Bologna | |
| 2009/0031479 | A1 | 2/2009 | Rush, III | |
| 2009/0222964 | A1 | 9/2009 | Wiles | |
| 2011/0131695 | A1 | 6/2011 | Maddux | |
| 2011/0271428 | A1 | 11/2011 | Withnall et al. | |
| 2012/0079646 | A1 | 4/2012 | Belanger | |
| 2013/0061375 | A1 | 3/2013 | Bologna | |
| 2014/0033402 | A1 | 2/2014 | Donnadieu | |
| 2016/0051013 | A1 | 2/2016 | Mitchell, Jr. | |
| 2017/0105470 | A1 * | 4/2017 | Eaton | A42B 3/064 |
| 2018/0343952 | A1 * | 12/2018 | Lachance | A42B 3/121 |

* cited by examiner

PAD ASSEMBLIES FOR A PROTECTIVE SPORTS HELMET

CROSS-REFERENCE TO RELATED APPLICATIONS

This Application is a continuation of pending U.S. patent application Ser. No. 14/179,333 entitled "PAD ASSEMBLIES FOR A PROTECTIVE SPORTS HELMET," filed on Feb. 12, 2014, to be issued as U.S. Pat. No. 9,770,060 on Sep. 26, 2017, which claims the benefit of priority under 35 U.S.C. § 119 from U.S. Provisional Patent Application Ser. No. 61/763,760 entitled "VALVE RETAINER FOR PROTECTIVE HELMET WITH INFLATABLE BLADDER," filed on Feb. 12, 2013, and U.S. Provisional Patent Application Ser. No. 61/763,762 entitled "SPORTS HELMET BUCKLE WITH PROTECTIVE COVER," filed on Feb. 12, 2013, the disclosures of which are hereby incorporated by reference in their entirety for all purposes.

TECHNICAL FIELD

The invention relates to pad and buckle assemblies for use with a protective helmet for a player engaged in a contact sport, such as football, lacrosse or hockey. A valve retainer portion of the pad assembly extends through a shell of the helmet such that bladders associated with an internal pad assembly can be inflated or deflated from the exterior of the shell. A retainer cap portion of the pad assembly is readily detachable from the helmet shell using standard tools. A buckle portion of the buckle assembly includes a protective cover wherein the buckle secures a chin protector assembly to a protective sports helmet. The protective cover engages and surrounds a peripheral edge of the buckle to form an assembly while the helmet is worn during the course of play. The cover can be removed and replaced without detaching the buckle from the chin protector.

BACKGROUND OF THE INVENTION

Helmets for contact sports, such as those used in football, hockey and lacrosse, typically include a rigid outer shell, an internal pad assembly coupled to an interior surface of the shell, a faceguard or face mask, and a chin protector or strap assembly that removably secures the helmet on the wearer's head. The internal pad assembly can include a number of pad elements which may be formed from absorbent foam, air, gel or a combination thereof. Some pad elements are positioned within an air-tight housing and provided with inflatable bladders such that air can be utilized as an inflation fluid to adjust the dimensions of one or more of the pad elements. In many instances, at least one valve is provided on the internal pad assembly to facilitate the introduction or removal of air from the bladders. Openings may be provided in the helmet shell and an extent of the valves may be inserted through the openings so the bladders can be adjusted, including while the helmet is being worn by a player.

Because end portions of the valves extend through the shell openings and are exposed to the outer surface of the shell, they are susceptible to impacts and wear over time. Conventional valves are firmly press fit into the shell openings to avoid accidentally dislodging the valve from the shell and/or from the internal pad assembly. In some conventional helmets, fitment of the valve within the opening in the shell also functions to secure or partially secure the internal pad assembly to the inner surface of the shell. Because conventional valves are firmly press fit into the shell openings, removing the internal pad assembly from the shell is cumbersome and time consuming, and in many instances can result in damage to the valve and/or the internal pad assembly. Removal of the internal pad assembly and incidences of valve damage increase when the helmet is worn in inclement weather conditions, including cold temperatures.

In addition, the chin strap assembly includes a central protective element that generally overlies or extends below the helmet wearer's chin, and opposed elongated strap portions that extend outward from the central element and that are releasably coupled to the helmet. Typically, the protective helmet is provided with helmet attachment portions and each strap portion is provided with a buckle having a buckle attachment portion that is releasably engageable with a respective helmet attachment portion. One example of such a buckle is disclosed in U.S. Pat. No. 8,056,151, the entire contents of which are hereby incorporated by reference. Often the buckle is configured to be moveable along the strap portion to adjust the sizing and fit of the chin strap assembly to accommodate the wearer's anatomical features.

Because the buckles are typically secured to an exterior of the helmet, the buckles are exposed and often subjected to numerous impacts when the helmet is worn during the course of play. The buckles must therefore be durable and impact resistant to ensure the chin strap remains properly secured to the helmet during impacts. To obtain the necessary strength and durability characteristics for the buckle, metal is often preferred as the primary buckle material, however, there are some drawbacks to its use.

Features and advantages of the invention will be apparent to those skilled in the art upon review of the following detailed description and accompanying drawings.

SUMMARY OF THE INVENTION

The disclosed subject matter relates to a pad assembly for a protective sports helmet having an opening. The pad assembly includes a pad member residing within a pad housing. The pad assembly also includes a retainer having a projection that fits within the opening of the helmet. The pad assembly further includes a cap that is detachably coupled to the retainer, the cap including a base portion that fits within the opening of the helmet and a flange portion that fits within a countersunk recess of the helmet, wherein the cap detachably receives the projection.

The disclosed subject matter further relates to a protective helmet for contact sports. The protective helmet includes a helmet shell having an opening in the helmet shell, the opening extending from an external surface of the helmet shell to an internal surface of the helmet shell. The protective helmet also includes a countersunk recess in the external surface of the helmet shell, the countersunk recess disposed around the opening in the helmet shell. The protective helmet further includes a pad assembly having a pad member residing within a pad housing, a retainer having a projection that is received within the opening of the helmet shell, and a cap that is detachably coupled to the retainer, the cap including a base portion that is received within the opening of the helmet shell and a flange portion that is received within the countersunk recess of the helmet shell, wherein the cap detachably receives the projection.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
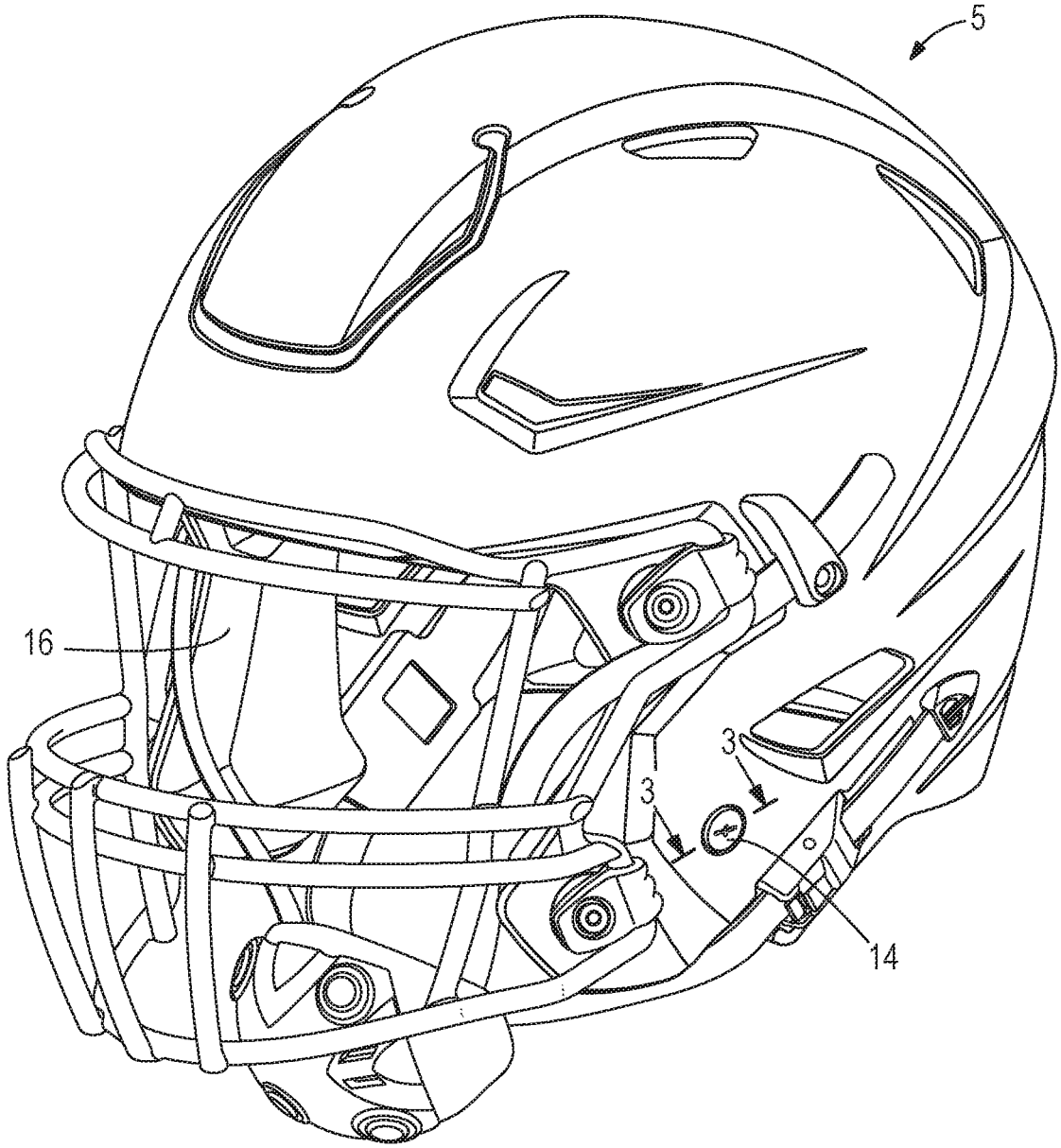
FIG. 1 is a perspective view of a protective sports helmet having a pad assembly.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
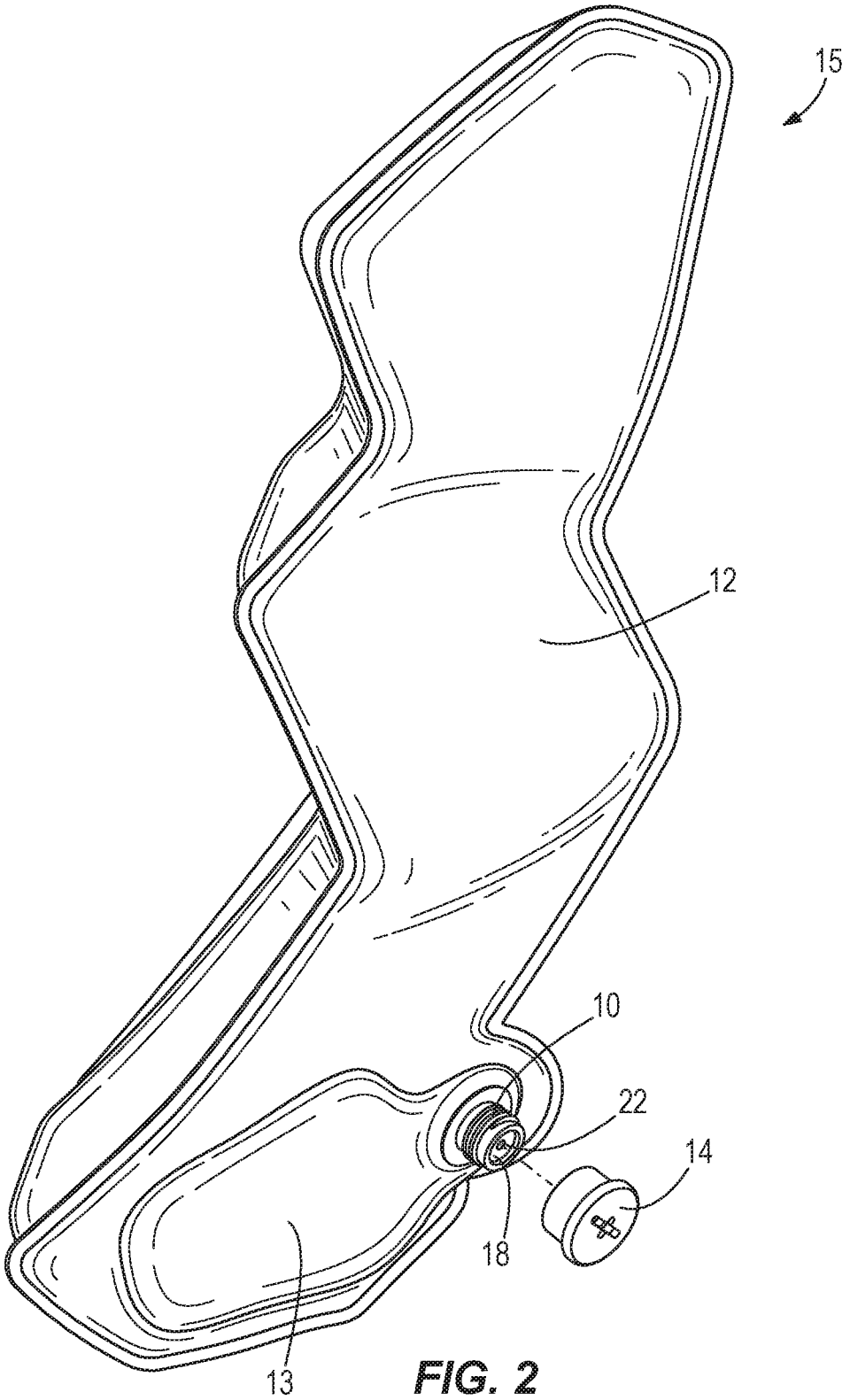
FIG. 2 is a perspective view of a pad assembly.
Figure 3:
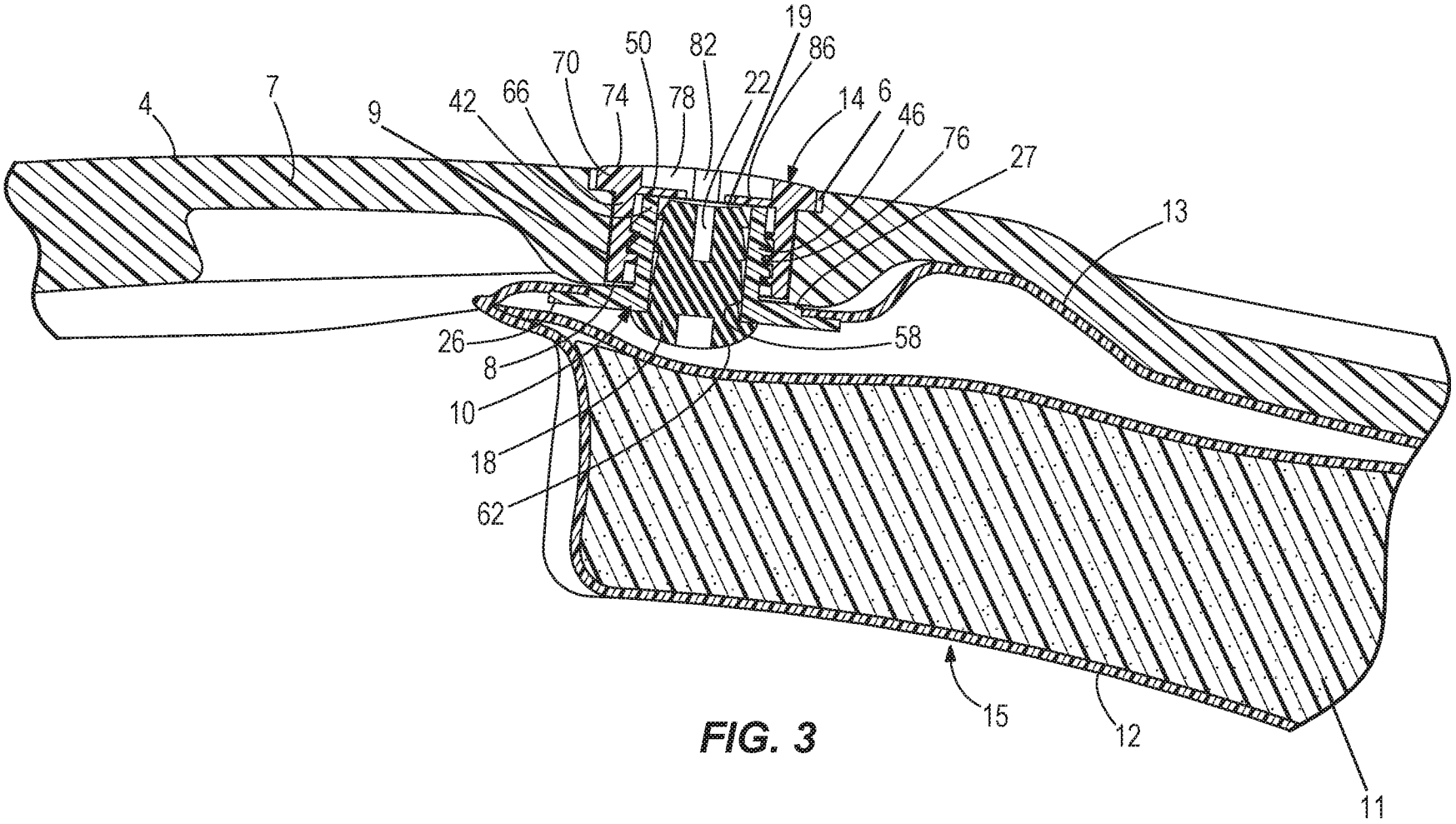
FIG. 3 is a cross-sectional side view of the pad assembly of FIG. 2.
Figure 4:
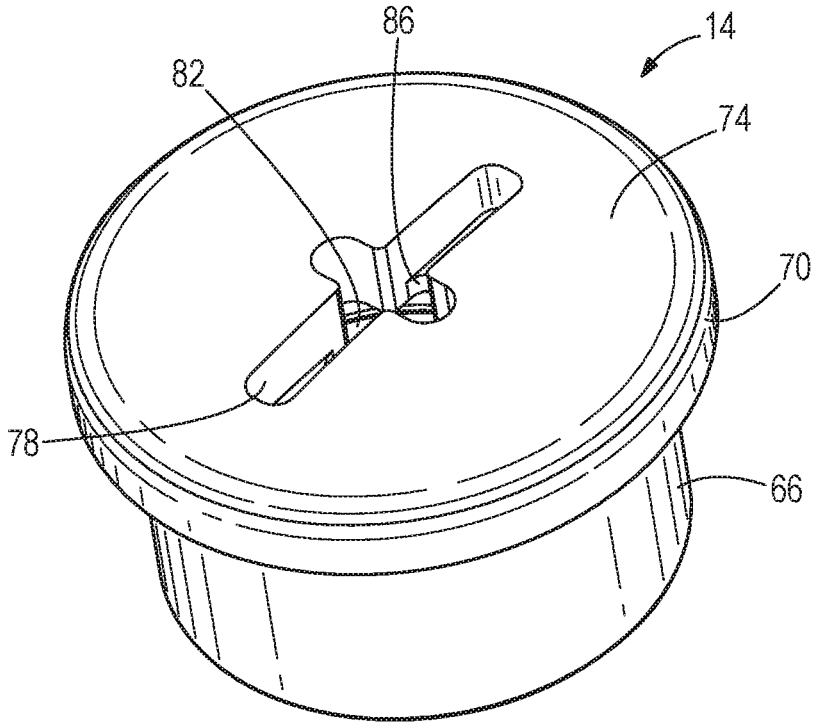
FIG. 4 is a perspective view of a retainer cap for use with the pad assembly of FIG. 2.
Figure 5:
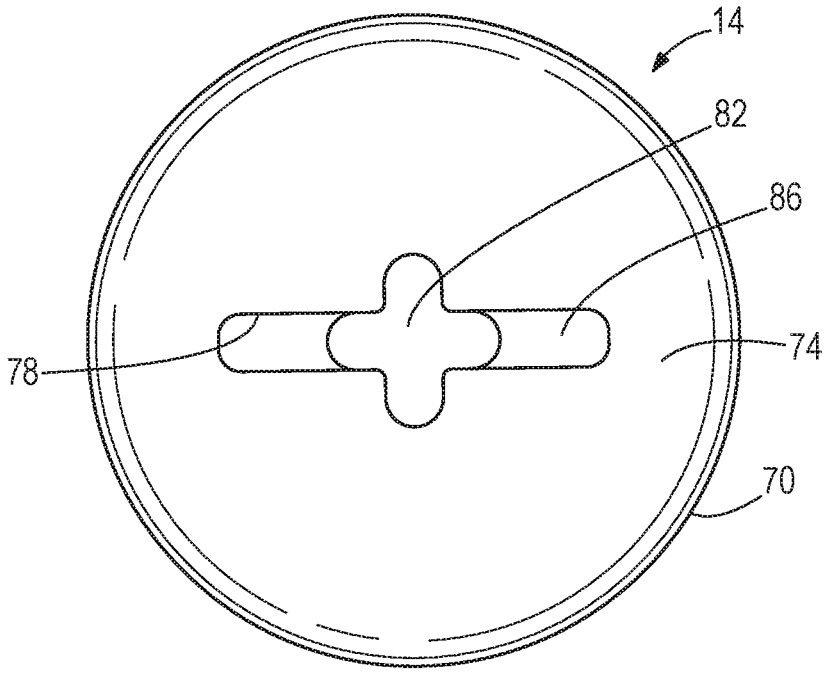
FIG. 5 is a top view of the retainer cap of FIG. 4.
Figure 6:
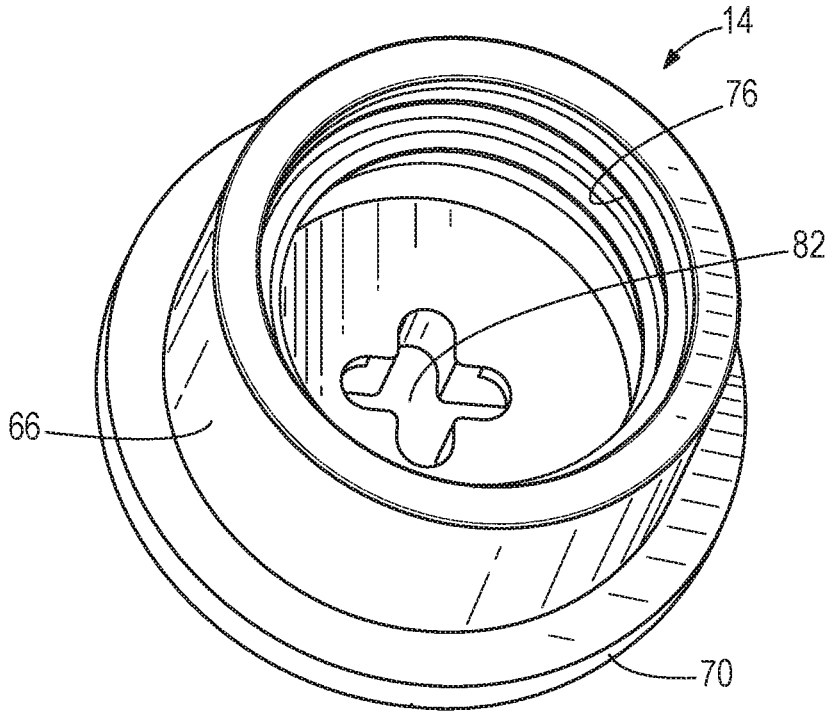
FIG. 6 is another perspective view of the retainer cap of FIG. 4.
Figure 7:
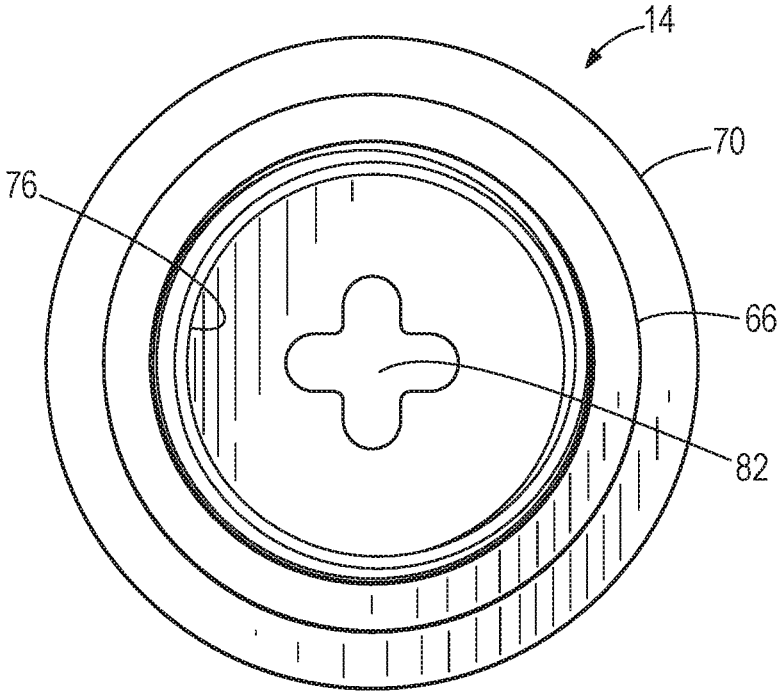
FIG. 7 is a bottom view of the retainer cap of FIG. 4.

FIGS. 1-3 illustrate a protective sports helmet 5 having an internal pad assembly 16 that includes a plurality of pad assemblies 15. The inventive pad assembly 15 may be a jaw pad, a crown pad, an earflap pad and the like. For example, an internal pad assembly 16 may include one or more crown pads positioned in the top area of the protective sports helmet 5, as well as a jaw pad and an earflap pad positioned on each side of the protective sports helmet 5.

FIGS. 4-7 illustrate a cap 14 configured for threaded engagement with a valve retainer 10 (illustrated in FIGS. 8-11), wherein a pad member 11, a pad housing 12, the valve retainer 10 and the cap 14 comprise the inventive pad assembly 15. One or more pad members 11 are disposed within the pad housing 12 and the pad housing 12 is positioned within the interior of a helmet shell 7. The valve retainer 10 is sealingly connected to or integrated with the pad housing 12. The valve retainer 10 extends through an opening 9 in the helmet shell 7, and the cap 14 is generally positioned within the opening 9 at the exterior of the protective sports helmet 5.

As shown in FIG. 3, a valve body 18 is received by the valve retainer 10 and includes a central opening 22 that is delimited by a sealing member 19, such as a check valve, a self-sealing material and the like. The valve body 18 is an elongated component that extends through at least a portion of the retainer 10 and allows inflation fluid, such as air and the like, to be compressed into or released from one or more bladders 13 associated with the pad assembly 15 of the helmet. The valve body 18 may include an end portion 62 that engages the second side 30 of the valve retainer 10 to axially locate the valve body 18 with respect to the valve retainer 10, the end portion 62 being in fluid communication with the bladder 13. In the event that the pad assembly 15 lacks an inflatable bladder 13, then the valve body 18 is omitted.

Figure 8:
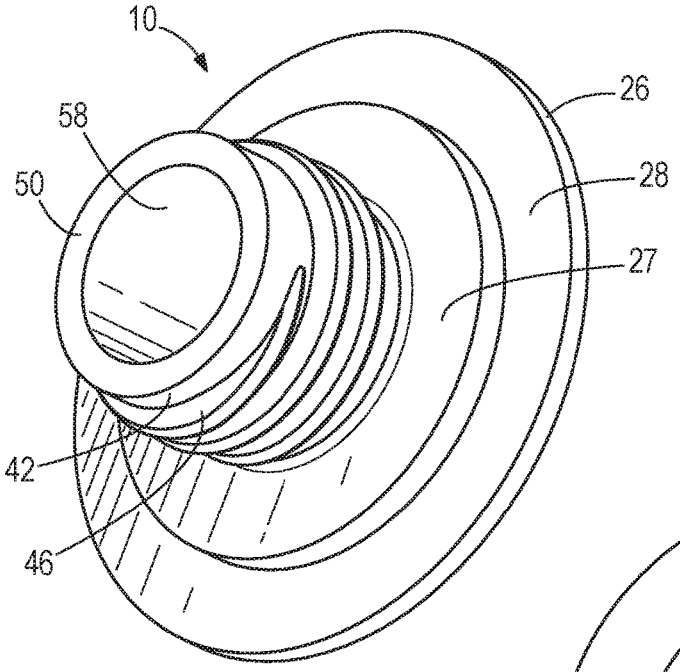
FIG. 8 is a perspective view of a valve retainer.
Figure 9:
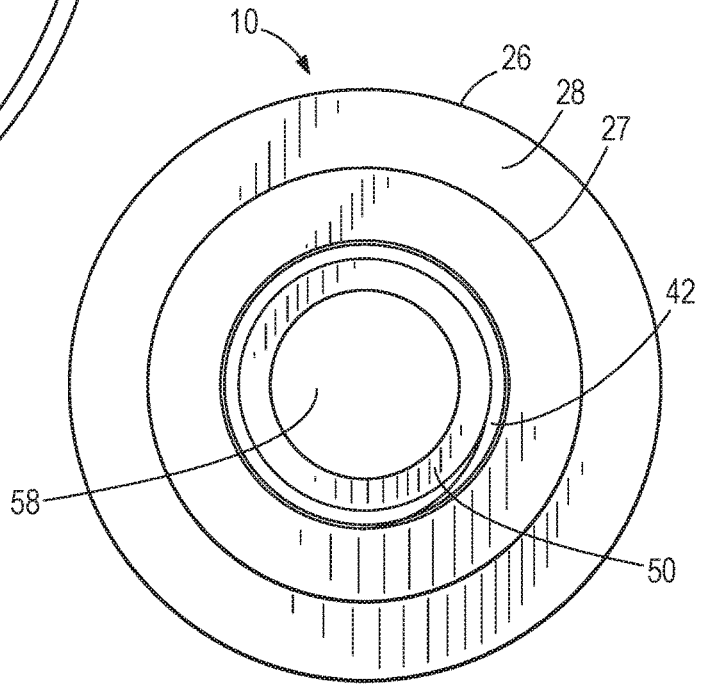
FIG. 9 is a bottom view of the valve retainer of FIG. 8.
Figure 10:
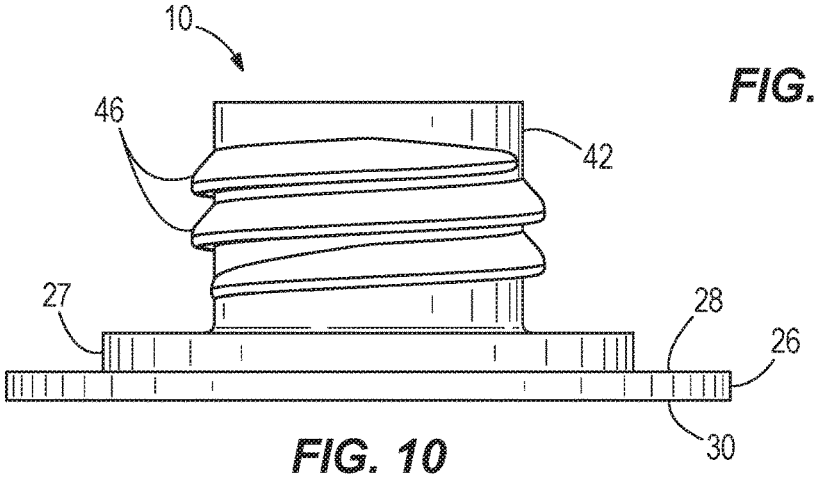
FIG. 10 is a side view of the valve retainer of FIG. 8.

As shown in FIGS. 8-10, the valve retainer 10 includes a plate-like base 26 having a first side 28 and a second side 30 opposite the first side 28. The base 26 may be circular, oval and the like. The valve retainer 10 also includes a boss 27 disposed on or integral with the first side 28 of the base 26, the boss 27 configured to provide a standoff with an inner surface 8 of the helmet shell 7. For example, the boss 27 may engage with an inner surface 8 of the helmet shell 7 that is disposed around the opening 9, helping to stabilize the position of the valve retainer 10 within the opening 9 of the helmet shell 7.

The valve retainer 10 also includes a projection 42, preferably threaded, extending generally perpendicularly away from the first side 28 and substantially centered on the base 26 and the boss 27. The projection 42 includes external threads 46 and a substantially annular end surface 50. The first side 28, the end surface 50, and the boss 27 may all be substantially parallel with one another. Alternatively, the boss 27 may extend in a convex shape from the first side 28 of the base 26, such that the boss 27 is thicker near the projection 42 than it is near the outer edge of the boss 27. At least a portion of the projection 42 is configured to extend through the opening 9 provided in the helmet shell 7. Preferably the entire projection 42 is disposed within the opening 9 so that the projection 42 is protected by the helmet shell 7.

A central through bore 58 of the valve retainer 10 extends through each of the threaded projection 42, the boss 27 and the base 26. The central through bore 58 is sized and configured to receive a valve body 18. The valve body 18 may be press fit or otherwise secured (e.g., by adhesives) within the central through bore 58. The base 26 of the valve retainer 10 is sealingly coupled to an exterior of a corresponding bladder 13 in the pad assembly 12 such that at least the second side 30 of the base 26 is in fluid communication with the bladder 13. The bladder 13 may be RF welded, molded, overmolded and the like to the valve retainer 10. For example, the material of the bladder 13 may be sealingly in contact with all of or a portion of the first side 28 of the base 26, and not in contact with the boss 27. When the valve retainer 10 is coupled to the pad housing 12 and the pad assembly 15 is secured to the interior of the helmet shell 7, the boss 27 engages with the inner surface 8 of the helmet shell 7 surrounding the opening 9, and the valve retainer 10 is substantially fixed with respect to the helmet shell 7.

Figure 11:
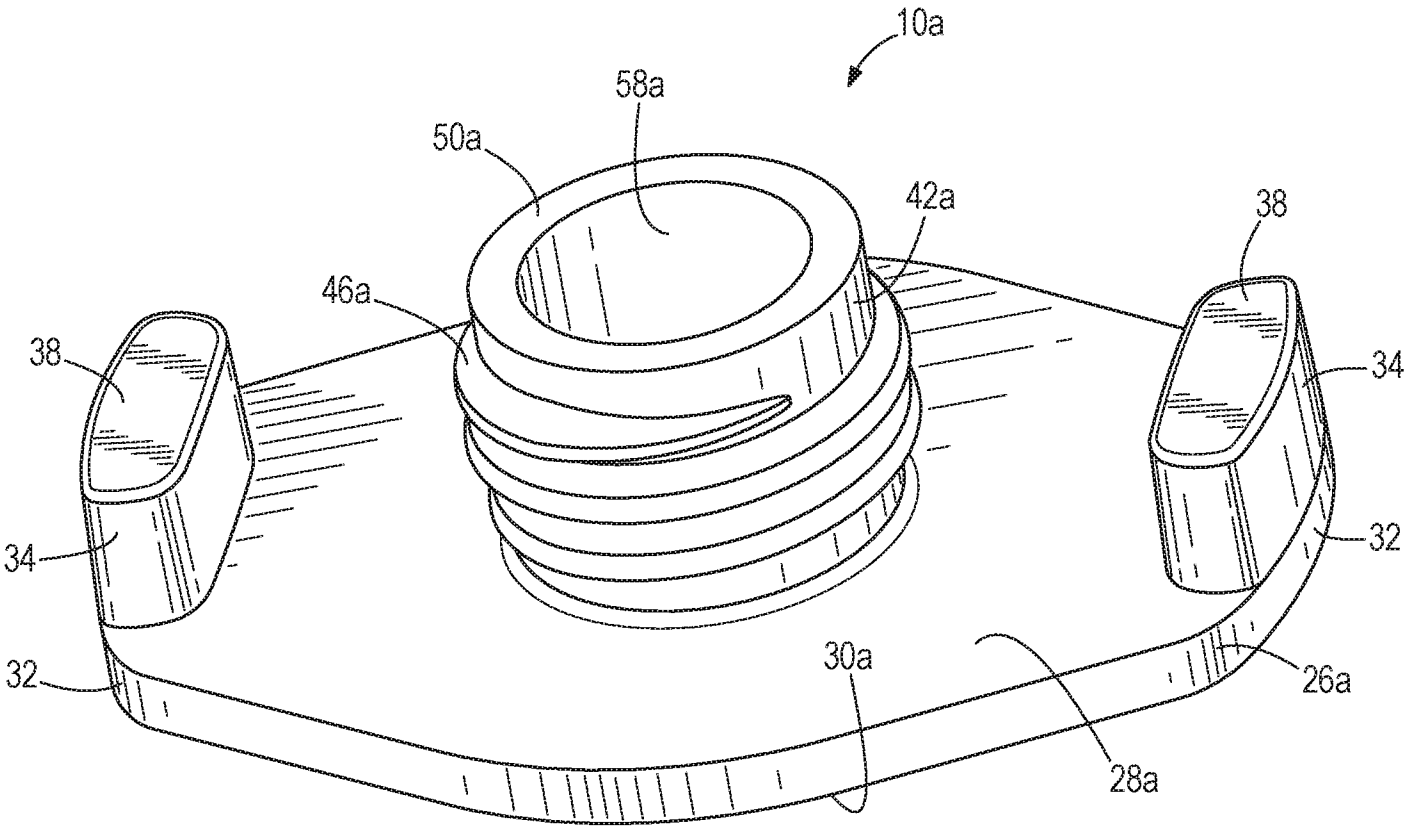
FIG. 11 is a perspective view of another valve retainer.

In an alternate embodiment as shown in FIG. 11, a valve retainer **10*a* includes a plate-like base 26*a* having a first side 28*a* and a second side 30*a* opposite the first side 28*a*. The base 26***a* is elongated and includes a pair of opposed distal ends 32. A standoff 34 extends generally perpendicularly away from the first side 28*a* at each distal end 32. End surfaces 38 of the standoffs 34 are configured for engagement with the inner surface 8 of the helmet shell 7.

The valve retainer 10*a* also includes a projection 42*a*, preferably threaded, extending generally perpendicularly away from the first side 28*a* and substantially centered on the base 26*a*. The projection 42*a* includes external threads 46*a* and a substantially annular end surface 50*a*. The first side 28*a*, the end surface 50*a*, and the end surfaces 38 are all substantially parallel with one another. A distance between the end surface 50*a* and the first side 28*a* is approximately two times a distance between the end surface 38 and the first side 28*a*. Thus, the length of the projection 42*a* is approximately twice the length of the standoffs 34. An extent of the projection 42*a* is configured to extend through the opening 9 provided in the helmet shell 7.

A central through bore 58*a* of the valve retainer 10*a* extends through each of the threaded projection 42*a* and the base 26*a*. The central through bore 58*a* is sized and configured to receive the valve body 18 (not shown). The valve body 18 may be press fit or otherwise secured (e.g., by adhesives) within the central through bore 58*a*. The second side 30*a* of the valve retainer 10*a* may be sealingly coupled to an exterior of a corresponding bladder 13 in the pad assembly 15 such that the valve body 18 is in fluid communication with the bladder 13. The valve retainer 10*a* can be RF welded to the exterior of the corresponding bladder 13. When the valve retainer 10*a* is coupled to the pad housing 12 and the pad assembly 15 is secured to the interior of the helmet shell 7, the valve retainer 10*a* is substantially rotationally fixed with respect to the helmet shell 7.

As shown in FIGS. 4-7, the cap 14 includes a generally annular base portion 66 and a generally circular flange portion 70 coupled to one end of the base portion 66 and extending radially outward from the base portion 66. The base portion 66 is internally threaded 76 for engagement with the external threads 46 on the projection 42. The base portion 66 is configured to extend into the helmet shell opening 9, which as discussed above is also occupied by the projection 42 of the retainer. In this regard, when the valve retainer 10 and cap 14 are installed in the helmet, portions of both the projection 42 of the valve retainer 10 and the base portion 66 of the cap 14 are threadedly engaged with one another while positioned in the shell opening 9 in the helmet shell 7.

As shown in FIG. 3, the flange portion 70 is configured to be received within a countersunk recess 6 provided on the external helmet shell surface 4 that is immediately adjacent to and surrounds the shell opening 9. In this regard the flange portion 70 rests on a shoulder defined by the differing diameters of the shell opening 9 and the countersunk recess 6. The flange portion 70 includes a top surface 74 and a manipulation recess 78 is formed in the flange portion 70 and recessed with respect to the top surface 74. When the cap 14 is positioned in the shell opening 9 and the countersunk recess 6, the top surface 74 of the flange portion 70 is substantially flush with the outer surface 4 of the helmet shell 7 (see FIG. 3). The manipulation recess 78 can be configured in a variety of ways for engagement with a standard manipulation device such as a screwdriver, star-bit, a coin, and the like. In the illustrated embodiment the manipulation recess 78 is generally in the shape of a cross, with one cross-member being longer than the other. The illustrated manipulation recess 78 is thus manipulatable using a flat blade or Phillips type screwdriver.

A through opening 82 is also provided in the flange portion 70 and, in the illustrated configuration, extends from a floor 86 of the manipulation recess 78 and through the flange portion 70. The through opening 82 thus communicates with the interior of the base portion 66 of the cap 14. When the cap 14 is threadedly coupled with the valve retainer 10, the through opening 82 is substantially aligned with the central opening 22 of the valve body 18. In the illustrated construction, the through opening 82 is generally cross shaped, which can accommodate slight axial misalignment of the through opening 82 with respect to the central opening 22.

With the cap 14 threadedly coupled with the valve retainer 10, the through opening 82 provides an access point for a standard inflation needle (not shown) to be inserted into the central opening 22 of the valve body 18. When the inflation needle is moved beyond the check valve or self-sealing material provided in the valve body 18, inflation fluid (e.g., air) can be introduced into or allowed to escape from the bladder 13 of the pad assembly 15 with which the valve retainer 10 is sealingly coupled.

The above described system of the valve retainer 10 and cap 14 facilitates the attachment, adjustment and removal of the pad assembly 15 without damaging or detaching the valve retainer 10 or valve body 18 from the pad assembly 15. For example, to attach the pad assembly 15 to the protective sports helmet 5, the pad assembly 15 is positioned such that the threaded projection 42 of the valve retainer 10 extends into the shell opening 9. The base portion 66 of the cap 14 is then inserted into the shell opening 9 and threadedly engaged with the threaded projection 42. In this regard, the base portion 66 is positioned radially outward of the projection 42 and the valve body 18. The cap 14 can initially be finger tightened and then, as the components begin to draw snug, a tool, such as a screwdriver, can be used to fully tighten the cap 14 and the valve retainer 10. Disassembly is the reverse operation, whereby the cap 14 is loosened and removed from the shell opening 9 and the valve retainer 10 can then be withdrawn from the internal side of the shell opening 9.

Figure 12:
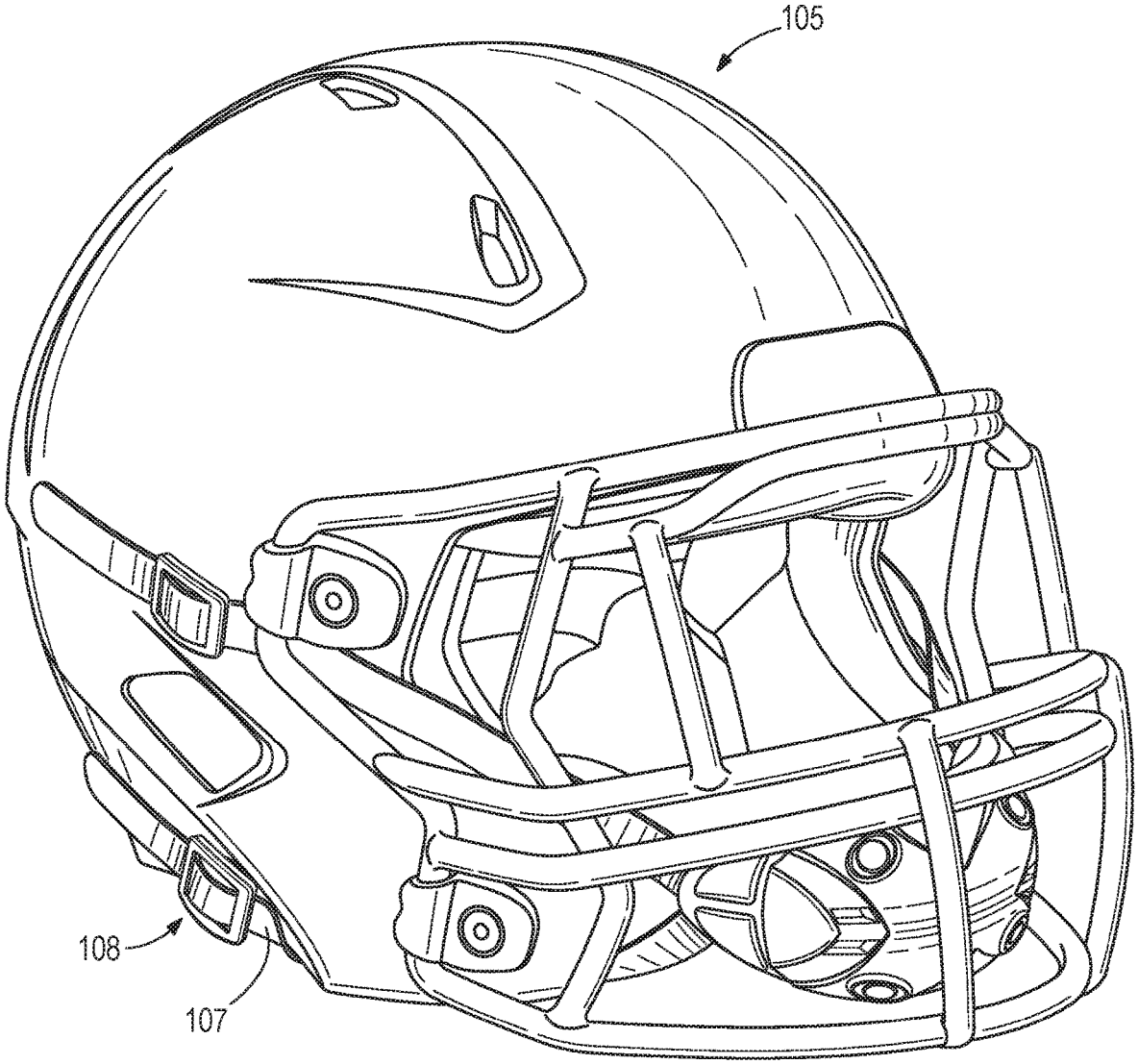
FIG. 12 is a perspective view of a protective sports helmet having a buckle assembly.

FIG. 12 illustrates a protective sports helmet 105 having a buckle assembly 108 that may be used, for example, to secure a chin strap 107 to the protective sports helmet 105. As shown in FIGS. 13-18, the buckle assembly 108 includes a protective cover 110 and buckle 114 that is inserted into or otherwise at least partially surrounded by the cover 110. The illustrated buckle 114 is formed of metal and includes a central body portion 118 having a first strap opening 122 and a second strap opening 126 formed therein. The first strap opening 122 and second strap opening 126 further have strap securing portions 122*a*, 126*a* that include a plurality of teeth that engage an extent of a chin strap to help secure the buckle 114 in a fixed location relative to the chin strap. Although not visible in FIGS. 13 and 14, the buckle 114 includes a generally rectangular perimeter defining an outer edge that is received by the cover 110, as discussed below.

Figure 13:
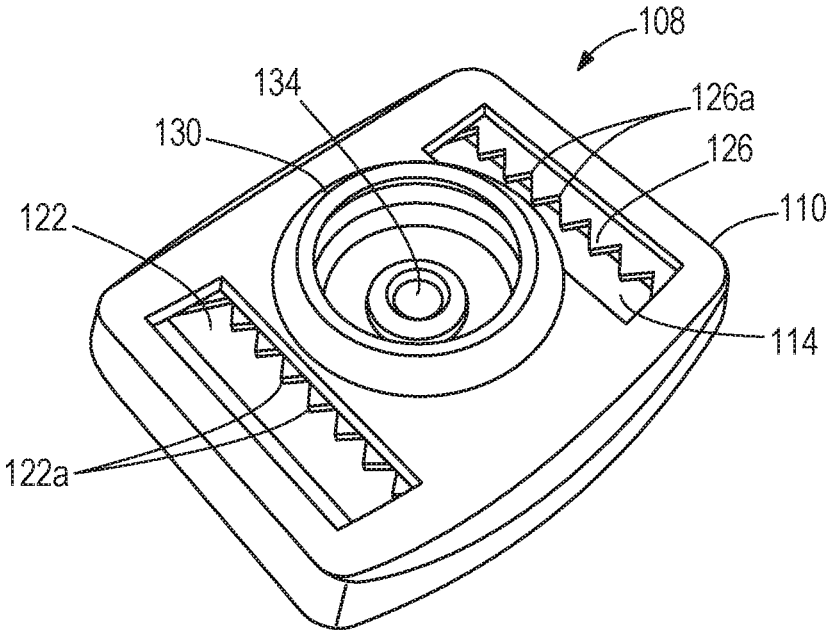
FIG. 13 is a bottom perspective view of a protective buckle cover and chin strap buckle.
Figure 14:
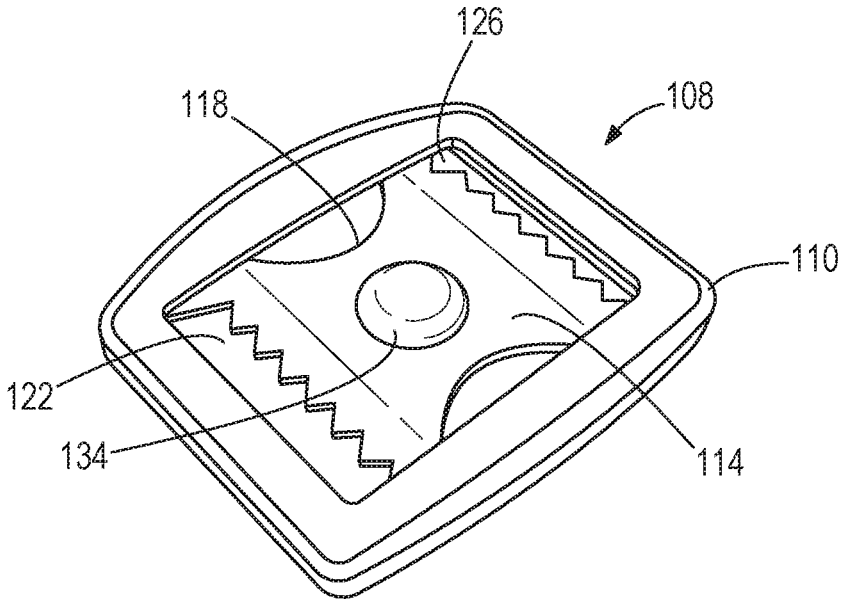
FIG. 14 is a top perspective view of the protective buckle cover and chin strap buckle of FIG. 13.
Figure 15:
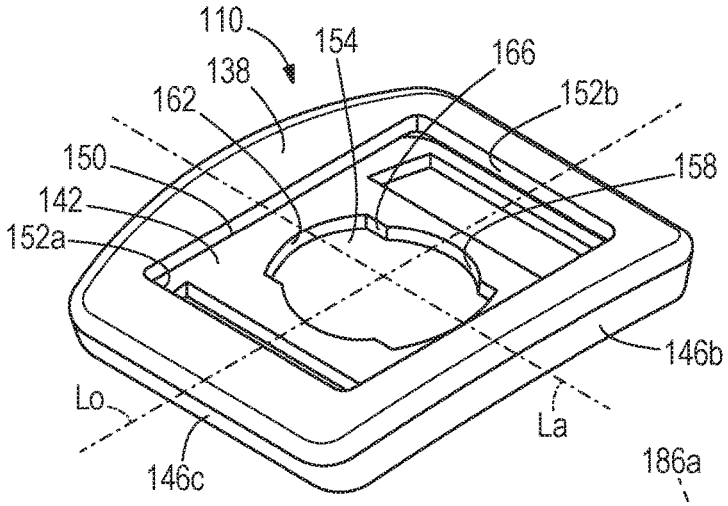
FIG. 15 is a perspective view of the protective buckle cover of FIG. 13.

As best shown in FIG. 13, an attachment portion 130 is provided on the buckle 114 to fasten the buckle 114 and the chin strap attached to the buckle 114 to the protective helmet. The attachment portion 130 includes a central rivet 134 and in the illustrated configuration forms the female component of a snap assembly, although the attachment portion 130 may also form the male component of a snap assembly, or may be configured as one portion of other known attachment types.

Referring further to FIGS. 15-18, the cover 110 is formed of a relatively soft, flexible material and in some configurations, the buckle 114 may be removably inserted into the cover 110. The buckle cover 110 includes a top wall 138, a bottom wall 142, and sidewalls 146*a*, 146*b*, 146*c*, 146*d* extending between the top wall 138 and the bottom wall 142. The cover 110 is generally rectangular and includes a longitudinal axis Lo and a lateral axis La. The sidewalls 146*a*, 146*b* extend in the longitudinal axis Lo and are therefore longer than the sidewalls 146*c*, 146*d*, which extend in the lateral direction La.

The top wall 138 defines a generally rectangular top opening 150. The top opening 150 is sized and configured to receive a portion of the chin strap that extends over the central body portion 118 and between the first and second chin strap openings 122, 126 of the buckle 114. The top opening 150 includes first and second laterally extending edges 152*a*, 152*b*. The bottom wall 142 defines a centrally located attachment opening 154 that is aligned with and that receives the attachment portion 130 of the buckle 114. The attachment opening 154 includes a pair of diametrically opposed first arc segment edges 158 that extend generally in the lateral direction La and that have a first diameter, and a pair of diametrically opposed second arc segment edges 162 that extend generally in the longitudinal direction Lo and that have a second diameter greater than the first diameter. Laterally extending straight edge segments 166 extend between respective ends of the first arc segment edges 158 and second arc segment edges 162. In some configurations, including configurations where the cover 110 is removably securable to the buckle 114, the larger diameter second arc segment edges 162 facilitate insertion and removal of the attachment portion 130 with respect to the attachment opening 154. In other configurations, the attachment opening 154 may be a substantially uniform circle.

Figure 16:
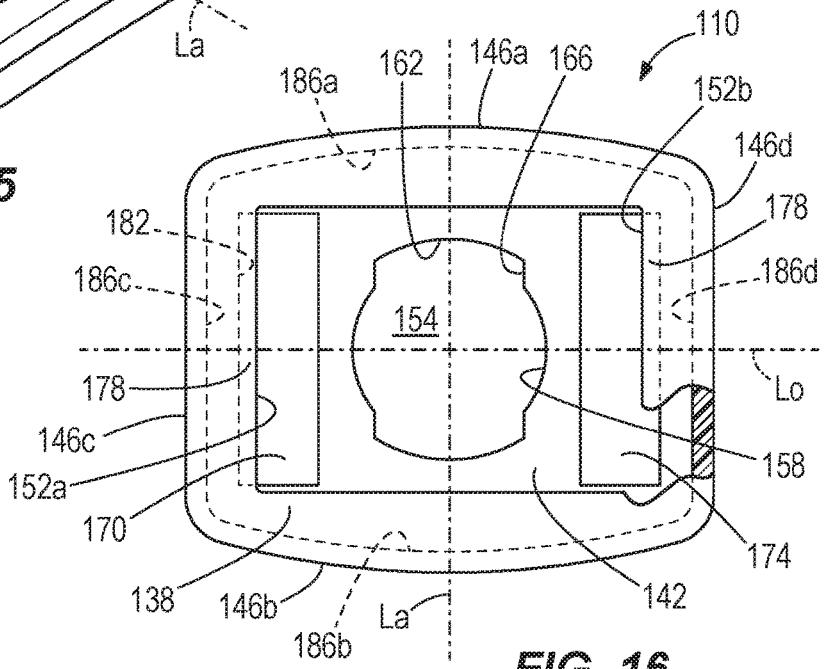
FIG. 16 is a top view of the protective buckle cover of FIG. 13.

The bottom wall 142 also defines a first strap opening 170 and a second strap opening 174. The first and second strap openings 170, 174 are substantially rectangular and are positioned for alignment with the first and second strap openings 122, 126 in the buckle 114 when the buckle 114 is inserted into the cover 110. As best seen in FIG. 16, the first and second strap openings 170, 174 have a length in the lateral direction La of the cover 110 that is substantially equal to a width (also in the lateral direction La) of the top opening 150. The length of the strap openings 170, 174 and width of the top opening 150 generally are selected to correspond to the width of the chin strap to which the buckle 114 and cover 110 are to be attached. As also seen in FIG. 16, the edges 152*a*, 152*b* of the top wall 138 are inwardly spaced with respect to the outer, laterally extending edges of the first and second strap openings 170, 174. As a result, the top wall 138 includes overhanging portions 178 that extend above the first and second strap openings 170, 174.

As shown in FIGS. 15-18, the cover 110 defines a continuous channel 182 having a substantially C-shaped cross section extending around a periphery of the cover 110. The channel 182 is configured to receive and surround the perimeter and outer edge of the buckle 114. The channel 182 is cooperatively defined by the top wall 138, the bottom wall 142, and the side walls 146*a*, 146*b*, 146*c*, 146*d*. The channel 182 includes four channel segments 186*a*, 186*b*, 186*c*, 186*d* with each segment associated with a respective one of the side walls 146*a*, 146*b*, 146*c*, 146*d*. Segments 186*a* and 186*b* comprise side segments and extend in the longitudinal direction Lo.

As viewed from above (FIG. 16), the segments 186*a*, 186*b* are generally outwardly bowed such that the middle portions of the segments 186*a*, 186*b* are laterally separated by a greater distance than the end portions of the segments 186*a*, 186*b*. Segments 186*c* and 186*d* comprise end segments and extend in the lateral direction La. As viewed from above (FIG. 16) the segments 186*c*, 186*d* are substantially straight and parallel with one another.

As viewed from the side (FIG. 18), the segments 186*a* and 186*b* are uniformly curved such that the top wall 38 has a convex profile while the bottom wall 142 has a concave profile. The uniform curvature extends into the segments 186*c*, 186*d* such that, as viewed from the side (FIG. 18), the segments 186*c*, 186*d* are set at an angle or inclined in the longitudinal direction Lo, with the outermost portions of the segments 186*c*, 186*d* being at a lower elevation than the inner portions of the segments 186*c*, 186*d*.

Figure 17:
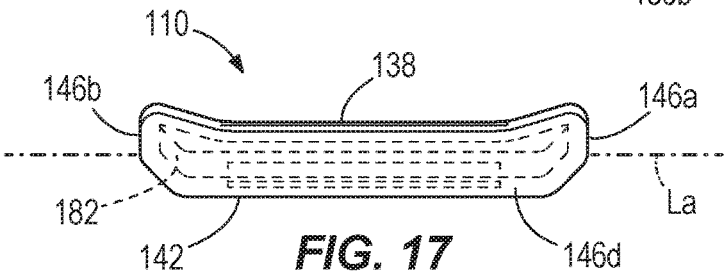
FIG. 17 is an end view of the protective buckle cover of FIG. 13.
Figure 18:
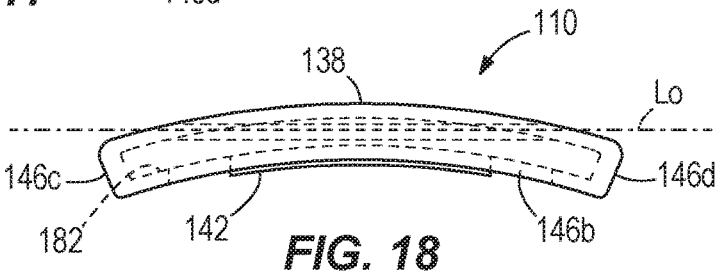
FIG. 18 is a side view of the protective buckle cover of FIG. 13.

As viewed from the end (FIG. 17), the segments 186*a*, 186*b* are set at an angle or inclined in the lateral direction La such that the laterally outer portions of the segments 186*a*, 186*b* are at a higher elevation than the laterally inner portions of the segments 186*a*, 186*b*. As also seen in FIG. 17, portions of the top wall 138 that define the segments 186*a*, 186*b* are also inclined such that the laterally outer edges of the top wall 138 are at a higher elevation than the laterally inner edges of the top wall 138.

When the buckle 114 is inserted into cover 110 and the chin strap is extended through the buckle 114 and the cover 110, the chin strap and the cover 110 cooperate to substantially completely cover the body portion 118 of the buckle 114. More specifically, the outer portions of the buckle 114 are received within the channel 182, and the central area of the body portion 118, e.g., where the central rivet 134 is located, is covered by the chin strap. In this regard there is little, if any, exposed buckle surface present on the exterior of the helmet when the buckle 114 is attached to the helmet to secure the chin strap. The cover 110 may be easily removed and replaced by flexing the top wall 138 to withdraw the buckle 114 from the channel 182 and then extracting the attachment portion 130 from the attachment opening 154. The cover 110 may be formed of a rubber material that can be colored to match or compliment the color of the chin strap, the face mask, and/or the helmet, thereby increasing the aesthetic appeal of the buckle assembly.

It is to be understood that the invention is not limited to the exact details of construction, operation, exact materials or embodiments shown and described, as obvious modifications and equivalents will be apparent to one skilled in the art. For example, the valve retainer may be integrally formed with a liner portion of the pad assembly. Accordingly, the invention is therefore to be limited only by the scope of the appended claims. While the specific embodiments have been illustrated and described, numerous modifications come to mind without significantly departing from the spirit of the invention, and the scope of protection is only limited by the scope of the accompanying claims.

What is claimed is:

1. A protective helmet for contact sports, the protective helmet comprising:

a helmet shell;

an opening formed in the helmet shell, the opening extending from an external surface of the helmet shell to an internal surface of the helmet shell;

an internal pad assembly including:

a pad member residing within a pad housing, the pad housing residing against the internal surface of the helmet shell;

a retainer extending from the pad housing and having a projection that is received within the opening of the helmet shell; and a cap including a base portion that is received within the opening of the helmet shell and a flange portion that extends radially outward from the base portion;

wherein the cap engages an extent of said retainer projection to secure the pad member adjacent to the internal surface of the helmet shell to define an installed position; and, wherein in the installed position, said cap base portion is positioned between said helmet shell opening and said retainer projection.

2. The protective helmet of claim 1, wherein the retainer includes a boss that engages the internal surface of the helmet in the installed position.

3. The protective helmet of claim 1, wherein the pad assembly includes a bladder, wherein the retainer is in fluid communication with the bladder.

4. The protective helmet of claim 1, wherein an upper surface of the cap includes a recess configured to engage a device that facilitates manipulation of the cap with respect to the retainer to attain the installed position.

5. The protective helmet of claim 4, wherein said recess is centrally disposed in the cap and centrally aligned with the opening.

6. The protective helmet of claim 1, wherein the cap includes a through opening extending through the flange portion and communicating with an interior of the base portion.

7. The protective helmet of claim 1, wherein the retainer includes external threads and the cap includes internal threads that are cooperatively dimensioned with the external threads of the retainer to facilitate engagement in the installed position.

8. The protective helmet of claim 1, wherein an outer surface of the cap is configured to be substantially flush with the external surface of the protective sports helmet in the installed position.

9. The protective helmet of claim 1, further comprising a valve body disposed within the projection of the retainer.

10. The protective helmet of claim 9, wherein the valve body comprises a check valve.

11. The protective helmet of claim 1, wherein the helmet is a football helmet and includes a face mask.

12. The protective helmet of claim 11, wherein the retainer includes external threads and the cap includes internal threads that are cooperatively dimensioned with the external threads of the retainer to facilitate engagement in the installed position.

13. A protective helmet for contact sports, the protective helmet comprising:

a helmet shell, the helmet shell including (i) an opening extending from an external surface of the helmet shell to an internal surface of the helmet shell, and (ii) a countersunk recess formed in the external surface of the helmet shell and being aligned with said opening; and a pad assembly including:

a pad member residing within a pad housing, the pad housing residing against the internal surface of the helmet shell;

a retainer extending from the pad housing and having a projection that is received within the opening of the helmet shell; and a cap including a base portion that is received within the opening of the helmet shell and a flange portion that extends radially outward from the base portion and that is received within the countersunk recess of the helmet shell; and, wherein in an installed position, the base portion of the cap receives an extent of the projection of the retainer to releasably secure the pad member adjacent to the internal surface of the helmet shell.

14. The protective helmet of claim 13, wherein the retainer includes a boss that engages with the internal surface of the helmet.

15. The protective helmet of claim 13, wherein the retainer is RF welded to the pad housing.

16. The protective helmet of claim 13, wherein the pad member further includes a bladder, and the retainer is in fluid communication with the bladder.

17. The protective helmet of claim 13, wherein the cap includes a recess configured to engage a device that facilitates manipulation of the cap with respect to the retainer to attain the installed position.

18. The protective helmet of claim 13, wherein the cap includes a through opening extending through the flange portion and communicating with an interior of the base portion.

19. The protective helmet of claim 13, wherein an outer surface of the cap is configured to be substantially flush with the external surface of the protective sports helmet in the installed position.

20. The protective helmet of claim 13, further comprising a valve body disposed within the projection of the retainer.

21. The protective helmet of claim 13, wherein in the installed position, said cap base portion is positioned between said helmet shell opening and said retainer projection.

22. The protective helmet of claim 13, wherein the protective helmet is a football helmet.

* * * * *